United States Patent [19]

Nomura

[11] 4,400,908

[45] Aug. 30, 1983

[54] MINIATURE VEHICLE ACTION TOY

[76] Inventor: Yoshiro Nomura, 17-5, 2- Chome, Kuramae, taito-ku, Tokyo, Japan

[21] Appl. No.: 363,437

[22] Filed: Mar. 29, 1982

[30] Foreign Application Priority Data

Oct. 2, 1981 [JP] Japan ..... 56-145962[U]

[51] Int. Cl.[3] ..... A63H 29/20

[52] U.S. Cl. ..... 46/209; 46/50

[58] Field of Search ..... 46/206, 207, 209, 50, 46/269, 211, 65

[56] References Cited

U.S. PATENT DOCUMENTS

| | | | |
|---|---|---|---|
| 2,708,811 | 5/1955 | Crowder | 46/209 X |
| 3,229,413 | 1/1966 | Bross | 46/50 X |
| 3,229,414 | 1/1966 | Bross | 46/206 X |
| 3,650,067 | 3/1972 | Greenwood | 46/209 X |
| 3,686,790 | 8/1972 | Winston | 46/206 X |
| 4,279,098 | 7/1981 | Kulesza et al. | 46/211 X |

FOREIGN PATENT DOCUMENTS

| | | | |
|---|---|---|---|
| 1537342 | 12/1978 | United Kingdom | 46/209 |

*Primary Examiner*—Mickey Yu

*Attorney, Agent, or Firm*—Salter & Michaelson

[57] ABSTRACT

A miniature vehicle action toy having an external rotating action element. The toy is inertially powered by an internal flywheel mounted on a drive shaft in the toy which is mechanically connected to the wheels to rotate therewith. The external action element is mounted on the drive shaft extremity outside of the toy body and rotates with the drive shaft to permit interesting and amusing play action of the toy. After the flywheel has been inertially energized, the toy can be balanced on the rotating action element and spun like a top.

6 Claims, 4 Drawing Figures

MINIATURE VEHICLE ACTION TOY

BACKGROUND AND SUMMARY OF THE INVENTION

The instant invention relates to inertially powered miniature toy vehicles and the like, and more particularly to an inertially powered miniature car action toy having an external action element which rotates with vehicular movement.

The broad concept of providing an internal flywheel in a miniature toy vehicle to provide inertial power therefor is well known in the toy industry. In this connection, the U.S. patents to LOREE, U.S. Pat No. 684,993; HEIN, U.S. Pat. No. 2,677,216; ANGIER, U.S. Pat. No. 3,570,175 and LEMELSON, U.S. Pat. No. 3,698,129 are generally demonstrative of the concept of inertially powering a toy vehicle with a flywheel, and represent the closest prior art pertaining to the inertial drive train of the toy of the instant invention of which the applicant is aware.

The broad concept of providing an external action element on a toy vehicle is also known but has heretofore been limited primarily to vehicles of the type powered by an external rotating propeller or other air thrust element. The U.S. patents to HANSBURG et al, U.S. Pat. No. 1,321,206 and LEMELSON, U.S. Pat. No. 3,878,642 teach toy vehicles of this type wherein an external rotating air thrust element powers the vehicle, said patents representing the closest prior art relating to the external action element features of the instant invention of which the applicant is aware.

While action toy vehicles of the two above mentioned types have heretofore been available, the action toy of the instant invention represents the first miniature vehicle of its kind wherein an external action element is mechanically connected to an inertial flywheel within the vehicle so that the external element rotates upon inertial vehicular movement. In this connection, the miniature vehicle of the instant invention includes a miniaturized vehicle body to which front and rear axles having front and rear wheels mounted thereon are journaled. A drive shaft which is mechanically connected to the front axle of the vehicle and rotates therewith, extends rearwardly through the vehicle and has an inertial flywheel mounted thereon adjacent the rear wall of the vehicle body. An external action element which comprises a simulated turbo fan of a jet engine and has a rearwardly directed tapered center pin is mounted on the drive shaft adjacent the rear wall of the body on the exterior thereof. When the vehicle is moved along a supporting surface, the flywheel inertially powers the vehicle in a conventional manner, while the external turbo fan on the vehicle rotates to simulate an operative turbo jet engine which is providing power for the vehicle. However, since the inertial flywheel is mounted on the drive shaft in the rear of the vehicle so that the center of gravity is also in the rear portion of the vehicle, when the flywheel is inertially energized, the vehicle can be balanced on the center pin of the turbo fan and spun like a top. This adds a new dimension of movement to the vehicle, and makes it capable of performing in a novel and interesting manner heretofore unknown in the prior art.

As a result, the miniature vehicle car action toy of the instant invention has specific advantages over the miniature vehicles heretofore known. In particular, the novel concept of combining an inertial flywheel and an external rotating element of the type herein disclosed in a miniature vehicle provides definite advantages over the previously known toys of this type. When the vehicle is operated in a conventional manner, the action element adds new and interesting movement to the vehicle; and when it is balanced on the center pin of the turbo fan, the vehicle is capable of a totally new type of movement. These features make the toy extremely effective for capturing the interest and attention of those operating the vehicle or observing it in its operation.

Accordingly, the primary object of the instant is to provide a miniature inertially powered vehicle having an external rotating action element thereon so that the vehicle can be operated in a conventional manner or balanced on a center pin of the action element and spun like a top.

Another object of the instant invention is to provide a vehicle having a flywheel mounted therein which simultaneously provides inertial power for the vehicle and rotates an external action element mounted thereon.

Another object of the instant invention is to provide an inertially powered miniature vehicle action toy which has the appearance of being powered by an operative turbo jet engine.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
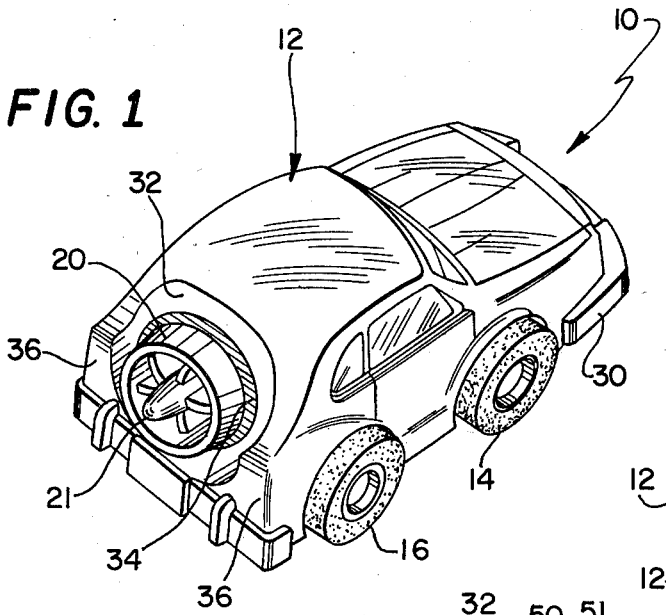
FIG. 1 is a perspective view of the toy vehicle of the instant invention.

Referring now to the drawing, the miniature vehicle action toy of the instant invention is generally indicated at 10 in FIGS. 1 through 4. The miniature car or vehicle 10 generally comprises a miniaturized vehicle body generally indicated at 12, front and rear wheels 14 and 16, respectively, a drive train generally indicated at 18, which is mechanically connected to the front wheels 14 for rotation therewith, and an external rotating element 20 having a tapered center pin 21 which is drivingly attached to the drive train 18 and therefore rotates with the front wheels 14. The drive train 18 includes a drive shaft 22, a crown gear 23 in driving engagement with the drive shaft 22, and a flywheel 24 which is mounted on the shaft 22 and operates to inertially power the vehicle 10.

The body 12 comprises a lower chassis 26, an upper shell 28 and a front bumper section 30. The shell 28, which is preferably molded of a suitable rigid plastic material, is generally formed in the configuration of an automobile body as clearly seen from FIG. 1, but is adapted to impart the vehicle 10 with the appearance of being powered by a turbo jet engine. In this connection, the shell 28 includes a substantially flat upwardly and forwardly inclined generally circular rear wall 32 having an enlarged circular opening 34 therethrough and a coweling section 36 which extends rearwardly from the lower perimeter of the wall 32. A generally horizontal rear assembly slot 38 is provided in the lower rear portion of the shell 28, and an assembly post 40 extends downwardly from the front portion thereof.

The chassis 26 is preferably integrally formed of a sheet metal and provides the main structural support for the vehicle 10. In this connection, the chassis 26 includes a bottom wall 42, reinforcing side walls 44 and an upwardly and forwardly inclined rear wall 46 of arcuate configuration having a central opening 48 and an upper assembly tab 50 which engages the shell 28 as at 51 when the chassis 26 and the shell 28 are in assembled relation. Axle mounting plates 52 are integrally formed in the rear portions of the side walls 44 for mounting the rear wheels 16 as will hereinafter be more fully be brought out, and integrally struck miniature assembly tabs 54 are formed in the bottom wall 42. An integrally struck assembly tab 56 extends rearwardly from the lower portion of the rear wall 46 into the slot 38 and a forward tongue 58 extends upwardly and forwardly from the bottom wall 42. A threaded screw 60 extends through the tongue 58, the bumper 30 and into the post 40 to maintain the components of the body 12 in the assembled positions thereof.

Figure 3:
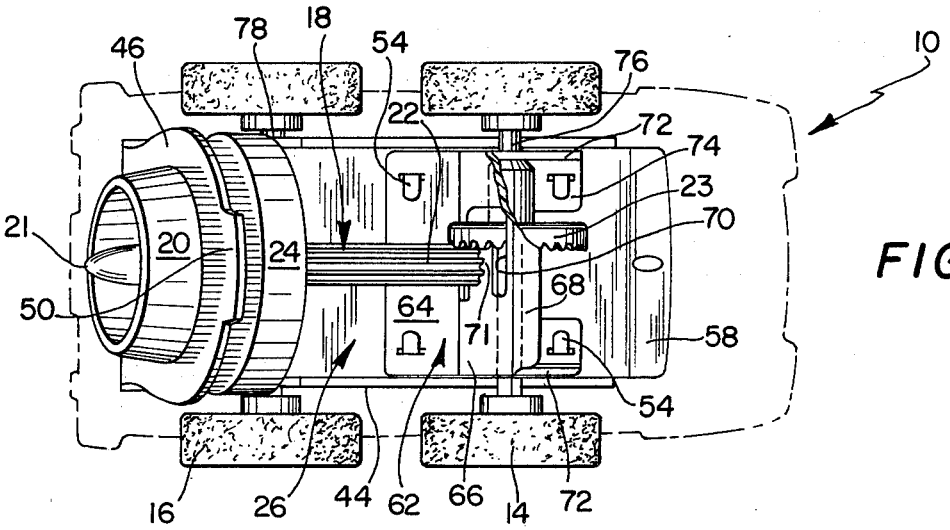
FIG. 3 is a top plan view of the vehicle chassis and drive train with the body of the vehicle illustrated in phantom.

A drive assembly bracket 62 is mounted on the chassis 26 and is secured thereto with the assembly tabs 54 as shown. The bracket 62, which is preferably made of a rigid sheet metal in unitary construction, includes a rear base portion 64 which overlays the bottom wall 42 and an upwardly and forwardly inclined gear plate 66 which terminates in a forwardly extending flange 68. A generally transverse U-shaped opening 70 extends through the gear plate 66 and defines a central transverse leg 71 thereon, as illustrated in FIG. 3. Side walls 72 having bottom feet 74 which overlay the bottom wall 42 and are secured thereto with assembly tabs 54, extend forwardly from the drive plate 66.

The front and rear wheels 14 and 16, respectively, are mounted on axles 76 and 78, respectively, and provide support for the miniature vehicle 10 in the movement thereof on a supporting surface. In this regard, the axle 76 is journaled for rotation in the side walls 72 of the bracket 62 and the rear axle 78 is journaled for rotation in the mounting plates 52.

The drive train 18, as hereinabove noted, includes the drive shaft 22, the crown gear 23 and the flywheel 24 which is mounted on the drive shaft 22. In this connection, the drive shaft 22 is formed as an elongated pinion gear and has reduced front and rear shaft ends 80 and 82, respectively, which are journaled to the central leg 71 on the drive plate 66 and to the rear chassis wall 46, respectively. The flywheel 24 is mounted on the shaft 22 proximal to the inner surface of rear wall 46, while the rear shaft portion 82 extends through the central rear wall opening 48, and the element 20, which comprises a simulated turbo fan, is mounted on the rear shaft portion 82 proximal to the external surface of wall 46, so that the tapered element 21 extends generally rearwardly. As will be seen from FIGS. 2 and 3, the crown gear 23 is mounted on the front axle 76 and accordingly rotates with the front wheels 14. The rear portion of the crown gear 23 extends through the U-shaped opening 70 so that the crown gear 23 intermeshes with the pinion gear drive shaft 22 to communicate rotation thereto and thus communicate rotation from the front wheels 14 to the flywheel 24 and the external action element 20.

Figure 4:
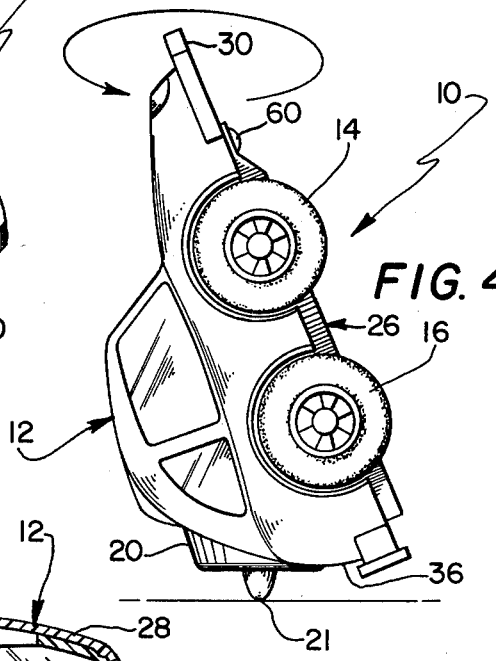
FIG. 4 is an elevational view of the toy vehicle as it is rotated while balanced on the balancing pin.
Figure 2:
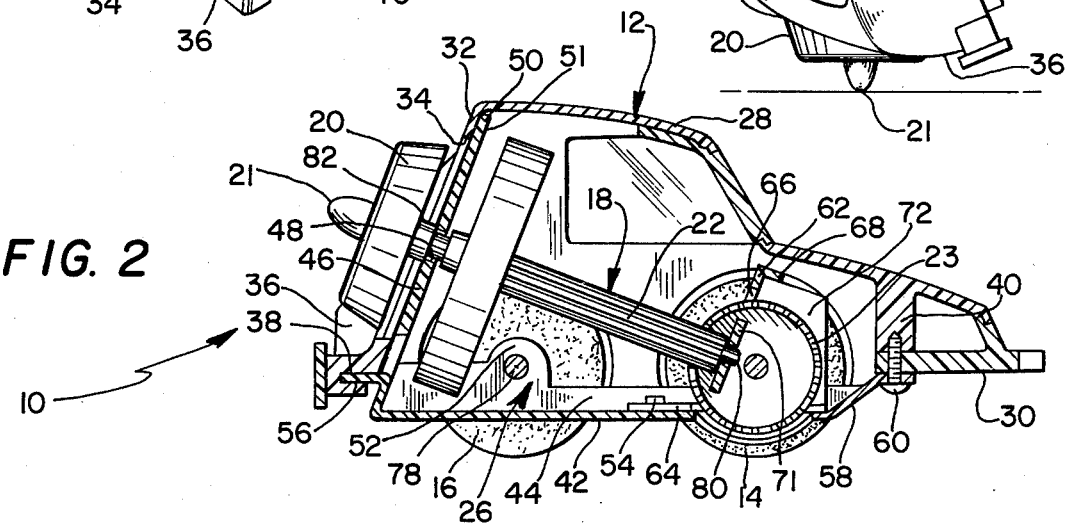
FIG. 2 is a side sectional view thereof.

It is seen therefore that miniature vehicle 10 of the instant invention provides a novel and interesting action toy which includes both an inertial drive train and an external rotating element. The external element 20, including the tapered pin 21, and the flywheel 24, are mounted proximal to the rear wall 32 on a common shaft which is mechanically connected to the front drive wheels 14 and therefore both the wheels 14 and the action element 20 rotate upon inertial energization of the flywheel 24. The rotation of the element 20 provides added interesting movement on the vehicle 10 when it is moved across a supporting surface in a conventional manner. However, because the flywheel 24 is mounted in generally transverse relation in the vehicle 10 proximal to the rear wall 32, when the flywheel 24 is inertially energized, the vehicle can be balanced on the tapered center pin 21 and spun like a top, as is illustrated in FIG. 4. More particularly, by rapidly moving the vehicle 10 across a supporting surface, the flywheel 24 can be sufficiently inertially energized so that the vehicle 10 can be balanced on the element 21 for an extended period of time until the frictional drag caused by the drive train causes the denergization of the flywheel 20. This provides a new dimension of interesting movement in the vehicle 10 which was heretofore unknown in the prior art. As a result of the above, the vehicle 10 is substantially more effective than the vehicle toys of the prior art at capturing the attention and interest of both operators and observers thereof and represents a significant development in the field of miniature toy vehicles.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A miniature vehicle action toy comprising:

a. a miniaturized vehicle body;

b. a plurality of wheels rotatably mounted on said body and supporting same for movement on a supporting surface, at least one of said wheels comprising a drive wheel;

c. a drive shaft rotatably mounted on said vehicle, one end of said shaft being disposed within said body, the other end of said shaft being disposed external of said body;

d. an inertial flywheel mounted on said drive shaft;

e. an external rotatable action element mounted on said shaft external of said body, said action element having a center balancing pin; and f. means drivingly connecting said shaft to said drive wheel for rotation therewith, whereby when said vehicle is manually advanced on a supporting surface so as to effect rotation of said drive wheel, rotation of said drive shaft, said flywheel and said external action element is also effected.

2. In the device of claim 1, said means drivingly connecting said drive shaft comprising an axle rotatably mounted in substantially transverse disposition on said body, and gear means communicating rotation from said axle to drive shaft means, said drive wheel being mounted on said axle and rotating therewith.

3. In the device of claim 2, said axle further characterized as a front axle, said wheel means further characterized as including a pair of front drive wheels mounted on said front axle, said drive shaft means extending rearwardly and upwardly from said front axle, said rotating element being mounted on the rear end of said drive shaft means on the exterior of said vehicle.

4. In the device of claim 3, said element comprising a simulated turbo fan having a center balancing pin.

5. In the device of claim 1, said flywheel means further characterized as being disposed substantially transversely in the rear of said vehicle.

6. In the device of claims 1 or 3, said body having a substantially flat upwardly and forwardly inclined rear wall, the rear portion of said drive shaft means being journalled to said wall, said rotating element being mounted on said drive shaft means proximal to said wall and rearwardly thereof, said flywheel means being mounted on said drive shaft means proximal to said wall and forwardly thereof.

* * * * *